US005351785A

United States Patent [19]

DuRapau

[11] Patent Number: 5,351,785

[45] Date of Patent: Oct. 4, 1994

[54] FOLDING SAWHORSE WITH LOCKING SHELF

[75] Inventor: Kenrick J. DuRapau, Austin, Tex.

[73] Assignee: Storehorse, Inc., San Antonio, Tex.

[21] Appl. No.: 977,113

[22] Filed: Nov. 16, 1992

[51] Int. Cl.[5] ..... B27B 21/00

[52] U.S. Cl. ..... 182/153; 182/225

[58] Field of Search ..... 182/152–155, 182/181–186, 224–227, 165

[56] References Cited

U.S. PATENT DOCUMENTS

| | | | |
|---|---|---|---|
| 604,482 | 5/1898 | Seaman | 182/176 |
| 3,817,349 | 6/1974 | Barthel | 182/155 |
| 3,857,604 | 12/1974 | Scott | 297/16 |
| 4,113,056 | 9/1978 | DeLorenzo | 182/153 |
| 4,124,093 | 11/1978 | Breisch | 182/181 |
| 4,298,186 | 11/1981 | Glass | 182/183 X |
| 4,429,765 | 2/1984 | Garcia | 182/153 |
| 4,494,627 | 1/1985 | Arent | 182/224 X |
| 4,620,613 | 11/1986 | Albertson | 182/153 |
| 4,756,385 | 7/1988 | Dietz et al. | 182/225 X |
| 4,771,863 | 9/1988 | Stansberry | 182/155 |
| 4,790,411 | 12/1988 | Ottoson | 182/155 |

FOREIGN PATENT DOCUMENTS

| | | | |
|---|---|---|---|
| 372618 | 5/1932 | United Kingdom | 182/153 |

OTHER PUBLICATIONS

Iron Horse By Hirsh.

*Primary Examiner*—Alvin C. Chin-Shue

*Attorney, Agent, or Firm*—Shaffer & Culbertson

[57] ABSTRACT

A folding sawhorse of the type comprising two trestle like frames that are hingedly connected at their tops. Wherein the improvement makes use of a pivoting shelf member for the purpose of controlling the open and close movements of these frames. The shelf is hingedly attached to a lower strut of one frame and slidably attached to the legs of the opposite frame. The slidable attachment is by means of pins that are secured to one end of the pivoting shelf and are also engaged in longitudinal slots that are in the legs of the opposite frame. To open the sawhorse from its closed, storage position, the frames are spread apart slightly, thereby allowing gravity to pull the shelf downward and concurrently causing the frames to spread outwardly to their open, working position. The sawhorse will stay in this locked open position without any additional latching mechanisms until the close procedure is initiated. To close the sawhorse for storage, a light upward pressure is applied on the edge of the pivoting shelf, causing it to move upwardly and concurrently causing the frames to pivot inwardly toward each other to their closed storage position. The improved folding sawhorse is further comprised of a removable, and replaceable top piece that is attached to only one of the frames and is also reversible from a tray top to a solid top, and overhangs the width of the frames thereby facilitating the clamping down of materials to the top piece.

7 Claims, 2 Drawing Sheets

FOLDING SAWHORSE WITH LOCKING SHELF

BACKGROUND OF THE INVENTION

This invention relates to sawhorses, scaffolds and trestles, and more particularly to a sawhorse that may be opened for use and folded to collapse for storage.

Sawhorses are used as racks or trestles to support construction materials and other objects. With their wide base, sawhorses provide a relatively stable support for a workpiece while being fairly portable. However, non-folding sawhorses require substantial space for storage and transportation.

Folding sawhorses therefore were created to solve the storage space problem and to allow for easier transportation. However, prior folding sawhorses had many shortcomings. Some prior folding sawhorses could not withstand sideways motion in the load they supported. This was particularly a problem with the type of folding sawhorse described in U.S. Pat. No. 4,884,658 to Banfield. The legs of this type of folding sawhorse that were positioned on a common side of the sawhorse were not in rigid contact with each other. The legs tended to pivot with respect to the upper central member of the sawhorse when the sawhorse was under load and therefore the sawhorse did not provide sufficient support when its load moved laterally with respect to the central supporting member.

Other folding sawhorses, such as the sawhorse described in U.S. Pat. No. 4,790,411 to Ottoson, provided significantly less vertical support than did non-folding sawhorses. The legs of these sawhorses tended to splay out under the pressure of applied weight because the sawhorse's opposing legs were not rigidly fixed to one another when the sawhorse was unfolded for use.

A folding sawhorse should readily unfold for use and fold up again for storage. Since most projects of the home owner are of short duration, if the sawhorse does not easily expand and collapse, it will be seldom used. Some folding sawhorses, such as the "IRON HORSE" manufactured by the Hirsh Company of Skokie, Ill. are both rigid and sturdy because their four legs are fixed relative to one another, but are difficult to unfold and fold.

SUMMARY OF THE INVENTION

It is therefore a general object of the invention to overcome the above described limitations and others associated with the prior folding sawhorses. More particularly, it is an object of the invention to provide a folding sawhorse that collapses or folds easily for storage and expands easily to a sturdy position for use.

To accomplish these objects, a folding sawhorse according to the invention includes a first frame, a second frame, a hinge connection between the frames, and a substantially rectangular shelf. The first frame includes a first elongated crossmember, a first pair of substantially parallel spaced apart legs extending from the first crossmember, and a first brace extending between the first pair of legs. The second frame includes a second elongated crossmember, a second pair of substantially parallel spaced apart legs extending from the second crossmember, and a second brace extending between the second pair of legs.

The hinge connection pivotally connects the first crossmember to the second crossmember so as to enable the first frame to pivot with respect to the second frame about a hinge axis. The hinge axis extends substantially parallel to the longitudinal axes of the cross members associated with both the first and second frame.

The shelf has, at a first side thereof, a slidable attachment connecting the shelf to opposing inner channels formed on the first pair of legs. At a second side, the shelf pivotally connects to the second frame. In this manner, the shelf is capable of sliding along the slidable attachment and pivoting at the second side between a storage position and a working position. In the storage position the first frame lies generally parallel to the second frame with the self folded therebetween. In the working position the planes defined by the first and second frames form generally two sides of an "A" shape with the shelf forming the cross portion of the "A" shape.

Preferably, the first elongated crossmember includes a first beveled surface and the second elongated crossmember includes a second beveled surface. The first and the second beveled surfaces reside in a common plane when the sawhorse is in the working position and together form a common supporting surface. The sawhorse includes a replaceable elongated top member that is removably attached to the first elongated crossmember along the first beveled surface. The elongated top member rests upon the second beveled surface when the sawhorse is in the working position, and provides a durable and replaceable surface to protect the frame cross members.

In the preferred form of the invention the shelf is pivotally connected to the second frame along the second brace and rests upon both the first and second braces when the sawhorse is in the working position. Since the shelf must pivot upwardly to collapse the sawhorse, the shelf serves to hold the sawhorse firmly in the working position and prevents the sawhorse from collapsing during use. When the sawhorse is in the working position, the shelf rigidly holds the four legs in position so that they do not move with respect to one other. Such rigid positioning of the legs, coupled with the hinge connection between the rigid frames prevents relative motion among the sawhorse components to produce a sturdy rigid support structure.

The unique attachment of the shelf to the frames also enables the sawhorse to be collapsed easily from the working position to the storage position. Even though the sawhorse provides a rigid and sturdy support in the working position, the shelf connection and the pivot connection between frames allows the sawhorse to collapse into a significantly smaller volume for storage and transportation. In addition to holding the sawhorse in the working position, the shelf also provides a secure location upon which a user may place tools, parts, and other objects used during a project.

These and other objects, advantages, and features of the invention will be apparent from the following description of the preferred embodiments, considered along with the accompanying drawings.

DESCRIPTION OF THE PREFERRED EMBODIMENT

Figure 2:
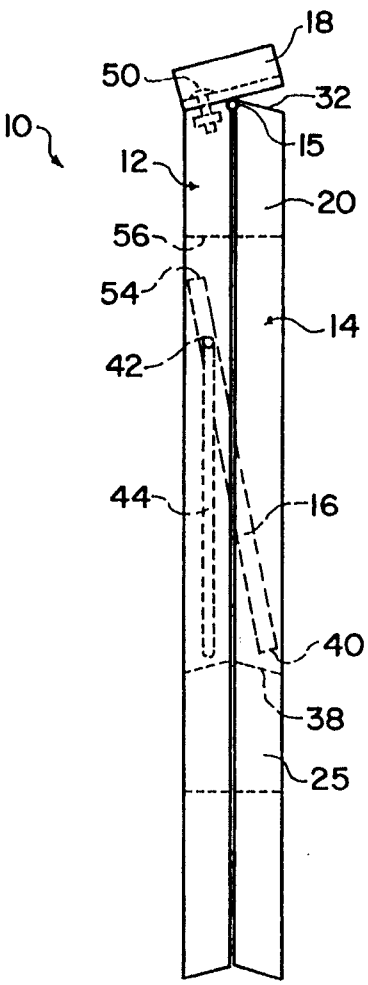
FIG. 2 is a side elevation of the folding sawhorse when in the storage position.
Figure 1:
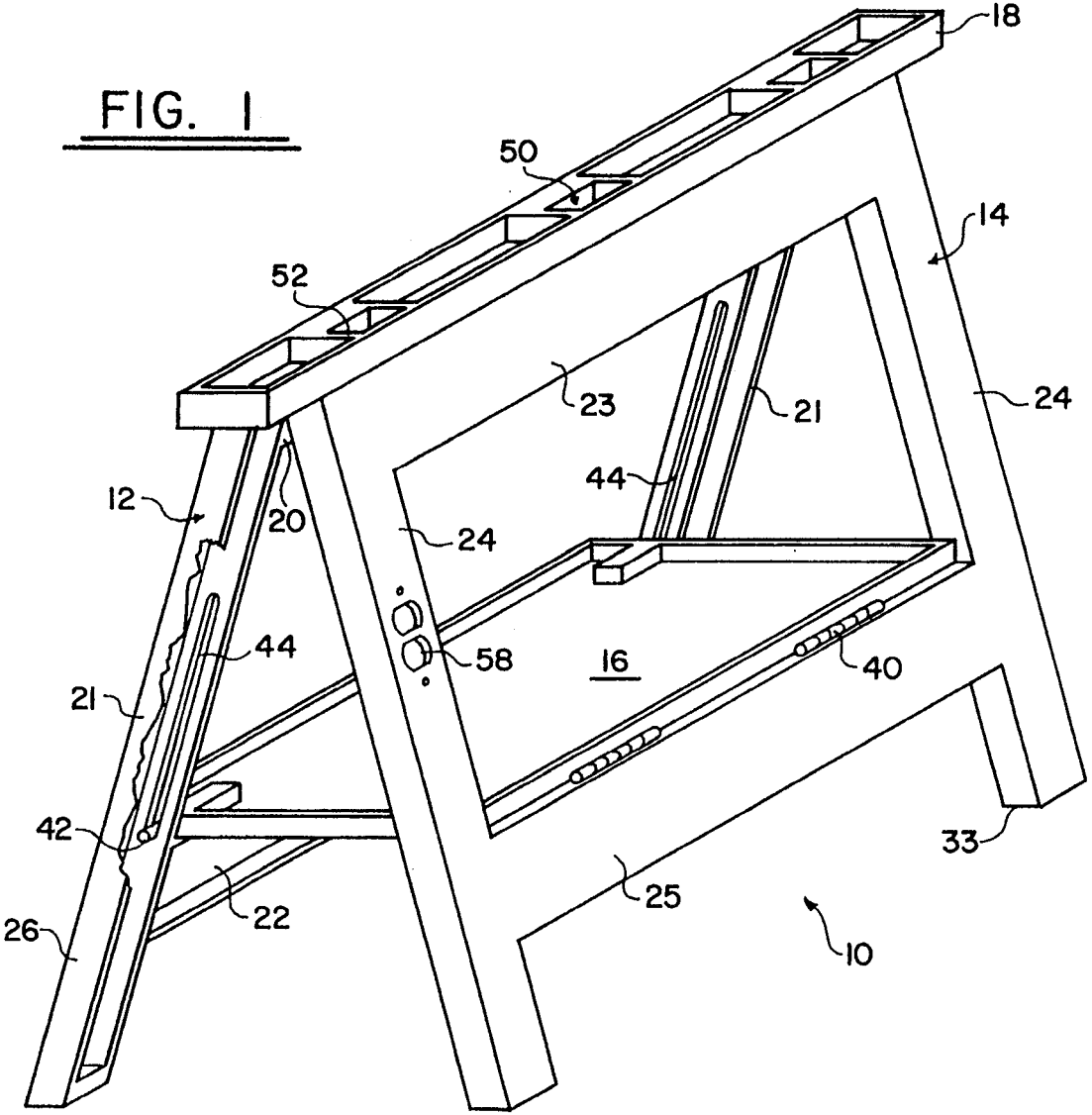
FIG. 1 is a perspective view of a folding sawhorse embodying the principles of the present invention in the working position.

A folding sawhorse embodying the principles of the present invention is shown by way of illustration in FIGS. 1 through 5. Referring to FIGS. 1 and 2, the folding sawhorse 10 comprises a first frame 12, a second frame 14, a hinge connection 15, and a substantially rectangular shelf 16. Preferably, the folding sawhorse also includes a top member 18.

The first frame 12 comprises a first elongated crossmember 20, a first pair of substantially parallel spaced apart legs 21 extending from the crossmember, and a brace 22 extending between the first pair of legs. The second frame 12 comprises a second elongated crossmember 23, a second pair of substantially parallel spaced apart legs 24 extending from the second crossmember, and a second brace 25 extending between the second pair of legs.

The hinge connection 15 pivotally connects the first crossmember 20 to the second crossmember 23 so as to enable the first frame to pivot with respect to the second frame about a hinge axis substantially parallel to both a longitudinal axis of the first crossmember 20 and a longitudinal axis of the second crossmember 23. The hinge connection 15 enables the folding sawhorse 10 to move from a working position as shown in FIG. 1 to a storage position as shown in FIG. 2.

Figure 4:
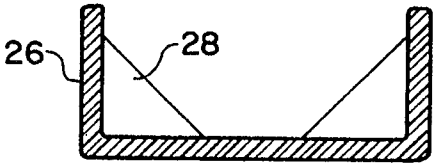
FIG. 4 is a transverse sectional view of a frame of the folding sawhorse.

To provide rigidity and strength and to also to minimize weight and material usage, the sawhorse 10 components are preferably constructed of reinforced plastic resin molded into the desired form. Referring to FIG. 4, a typical cross-section of the components of the sawhorse 10 consists of a ribbed outer edge creating a basic "C" shape and triangular shaped angle braces 28, formed in the molding process. The triangularly shaped braces serve to increase the rigidity of the frames 12 and 14 without greatly increasing their weight. Constructed in this manner, the sawhorse 10 is lightweight, rigid, resistant to moisture, and may be inexpensively constructed with minimal material usage.

Figure 5:
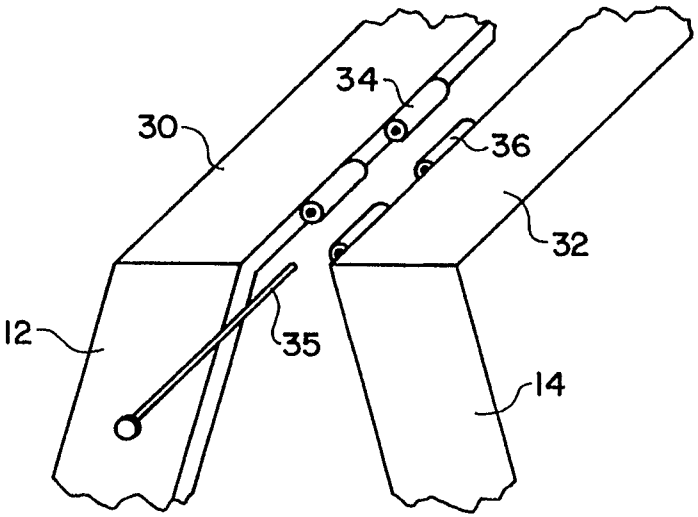
FIG. 5 is a partial view in perspective of the folding sawhorse detailing the hinge connection connecting the first and second frames.

Referring now to FIGS. 2 and 5, the first elongated crossmember 20 includes a first beveled surface 30 and the second elongated crossmember 23 includes a second beveled surface 32. The first and second beveled surfaces 30 and 32, respectively, are formed at an angle such that the surfaces reside in a common plane when the sawhorse is in the working position as shown in FIG. 1. Thus, the first and second beveled surfaces 30 and 32 form a common supporting surface that lies generally parallel to the surface on which the sawhorse 10 rests in the working position.

Referring particularly to FIG. 5, the hinge connection 15 preferably includes a first hinge body 34 formed in the first crossmember 20, a second hinge body 36 formed in the second elongated crossmember 23, and a pin 35. The pin 35 extends through the first hinge body 34 and second hinge body 36 to allow the hinge bodies to pivot with respect to one another. Preferably, the hinge bodies 34 and 36 are integrally formed in the frames 12 and 14 along the edge of the first and second beveled surfaces 30 and 32 respectively.

Referring again to FIGS. 1 and 2, the substantially rectangular shelf 16 includes, at a first side thereof, a slidable attachment includes pins 42 connecting the shelf to opposing inner channels 44 formed on the first pair of legs 21. At a second side of the shelf 16, a pivot connection 40 connects the shelf to the second brace 25. The shelf 16 is capable of sliding along the slidable attachment between the pins 42 and channels 44 at the first side thereof and pivoting at the second side. Therefore, the shelf 16 maybe easily moved from the working position, as shown in FIG. 1, to the storage position as shown in FIG. 2 by sliding the slidable attachment 42 upwardly within channels 44, and pivoting the shelf about connection 40. In the working position, planes defined by the first frame 12 and second frame 14 form generally two sides of an "A" shape with the shelf 16 comprising a cross portion of said "A" shape. Further, in the working position, the first and second sides of the shelf 16 rest upon the first and second braces 22 and 25 respectively, thereby adding further rigidity to the sawhorse and supporting the shelf. In the storage position, the plane defined by the first frame 12 is substantially parallel to a plane defined by the second frame 14 and the shelf 16 folds up to lie generally flat between the first and second frames.

Figure 3B:
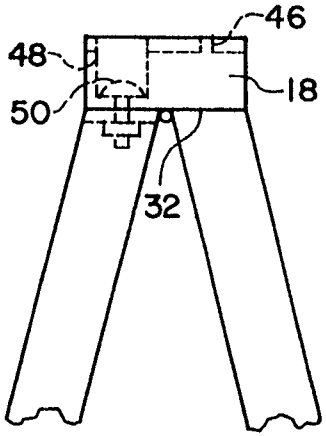
FIG. 3B is a partial elevational side view showing the elongated top member connected to the frames in an alternate position.
Figure 3A:
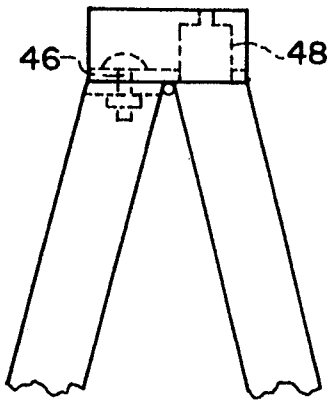
FIG. 3*a* is a partial elevational side view showing the elongated top member and its connection to first and second frames.

Referring to FIGS. 3A and 3B, the top member 18 is preferably formed so that it is reversible from a first to a second position. In the first position, as shown in FIG. 3A, the upper surface of the top member 18 presents a substantially flat working surface except for the small openings 46 required to pass bolts 50 through the top member that attach the top member to the first beveled surface 30 of the first frame 12. In the second position as shown in FIGS. 1 and 3B, the upper surface of the top member 18 has a plurality of open trays 52 for holding tools and working materials. Further, in the second position, bolts 50 pass through openings 48 in the top member 18 to attach the top member to the first beveled surface 30 of the first frame 12.

The top member 18 shown in FIG. 1 extends beyond the first and second beveled surfaces 30 and 32 respectively forming overhangs. These overhangs allow a user to use C-clamps to clamp materials, such as wood to be cut, to the top member 18. The top member 18, as shown in FIGS. 2, 3A, and 3B does not include this overhang and would be included with the sawhorse when the overhang feature was not desired.

To collapse the sawhorse 10 from the working position as shown in FIG. 1 to the storage position as shown in FIG. 2, upward pressure is applied to shelf edge 54 thereby pivoting shelf member upward and concurrently causing frames 12 and 14 to pivot inwardly towards each other. During this operation, the pins 42 affixed to the shelf 16 move upwardly within the opposing inner channels 44 formed on the first pair of legs 21. The second side of the shelf 16 meanwhile pivots with respect to the second brace 25. The shelf 16 therefore pivots to move the sawhorse 10 from the working position to the storage position wherein the first frame 12 is substantially parallel to a plane defined by the second frame 14.

Moving the sawhorse 10 from the storage position to the working position requires pivoting the frames 12 and 14 apart about the pivot connection 40. Gravity forces the pins 42 affixed to the shelf 16 downwardly within the opposing inner channels 44 formed on the first pair of legs 21. The second side of the shelf 16 meanwhile pivots with respect to the second frame 14. Once the shelf starts pivoting downwardly, downward pressure on the shelf edge 54 continues to separate the frames 12 and 14 until the shelf reaches the horizontal position shown in FIG. 1.

The above described preferred embodiments are intended to illustrate the principles of the invention, but not to limit the scope of the invention. Various other embodiments and modifications to these preferred embodiments may be made by those skilled in the art without departing from the scope of the following claims.

I claim:

1. A folding sawhorse comprising:

(a) a first frame having a first elongated crossmember, a first pair of substantially parallel spaced apart legs extending from the first crossmember, and a first brace extending between the first pair of legs;

(b) a second frame having a second elongated crossmember, a second pair of substantially parallel spaced apart legs extending from the second crossmember, and a second brace extending between the second pair of legs;

(c) a hinge connection pivotally connecting the first crossmember to the second crossmember so as to enable the first frame to pivot with respect to the second frame about a hinge axis substantially parallel to both a longitudinal axis of the first crossmember and a longitudinal axis of the second crossmember; and (d) a substantially rectangular shelf having at a first side thereof a slidable attachment to opposing inner channels formed on the first pair of legs and having a second side pivotally connected to the second frame, the shelf being capable of sliding along the slidable attachment at the first side thereof and pivoting at the second side between a storage position in which a plane defined by the first frame is substantially parallel to a plane defined by the second frame and a working position in which the planes defined by the first and second frames form generally two sides of an "A" shape with the shelf comprising a cross portion of said "A" shape.

2. The folding sawhorse of claim 1 wherein:

(a) the first elongated crossmember includes a first beveled surface; and (b) the second elongated crossmember includes a second beveled surface, the first and the second beveled surfaces residing in a common plane when the sawhorse is in the working position and forming a common supporting surface.

3. The folding sawhorse of claim 2 further comprising:

(a) an elongated top member that is removably attached to the first elongated crossmember along the first beveled surface, the elongated top member contacting the second beveled surface when the sawhorse is in the working position.

4. The folding sawhorse of claim 3 wherein:

(a) the surface of the elongated top member contacting the first and second beveled surfaces extends beyond the first and second beveled surfaces in at least one direction.

5. The folding sawhorse of claim 1 wherein:

(a) the shelf rests upon the first and second braces when the sawhorse is in the working position.

6. The folding sawhorse of claim 1 wherein:

(a) the slidable attachment to the opposing inner channels of the first pair of legs includes pins firmly attached to the shelf and extending from opposing ends of the shelf at the first side thereof into the opposing inner channels.

7. The folding sawhorse of claim 1 wherein the hinge connection includes:

(a) a first hinge body integrally formed in the first crossmember;

(b) a second hinge body integrally formed in the second crossmember; and (c) an elongated pin for pivotally connecting the first and second hinge bodies.

* * * * *